US009822958B2

(12) United States Patent
Jin et al.

(10) Patent No.: US 9,822,958 B2
(45) Date of Patent: Nov. 21, 2017

(54) TABLE LAMP

(71) Applicants: BOE TECHNOLOGY GROUP CO., LTD., Beijing (CN); BEIJING BOE CHATANI ELECTRONICS CO., LTD., Beijing (CN)

(72) Inventors: Shijia Jin, Beijing (CN); Fang Ren, Beijing (CN)

(73) Assignees: BOE TECHNOLOGY GROUP CO., LTD., Beijing (CN); BEIJING BOE CHATANI ELECTRONICS CO., LTD., Beijing (CN)

( * ) Notice: Subject to any disclaimer, the term of this patent is extended or adjusted under 35 U.S.C. 154(b) by 146 days.

(21) Appl. No.: 14/890,877

(22) PCT Filed: Jul. 14, 2015

(86) PCT No.: PCT/CN2015/083944
§ 371 (c)(1),
(2) Date: Nov. 12, 2015

(87) PCT Pub. No.: WO2016/138711
PCT Pub. Date: Sep. 9, 2016

(65) Prior Publication Data

US 2016/0377269 A1 Dec. 29, 2016

(30) Foreign Application Priority Data

Mar. 3, 2015 (CN) ..... 2015 1 0095574

(51) Int. Cl.
*F21S 8/08* (2006.01)
*F21V 21/29* (2006.01)
(Continued)

(52) U.S. Cl.
CPC ..... *F21V 21/29* (2013.01); *F21S 6/003* (2013.01); *F21V 17/105* (2013.01); *F21V 21/06* (2013.01);
(Continued)

(58) Field of Classification Search
CPC ..... F21V 21/20; F21V 21/29; F21V 21/30; F21V 21/34; F21V 17/105; F21S 6/002; F21S 6/003
(Continued)

(56) References Cited

U.S. PATENT DOCUMENTS 3,396,931 A * 8/1968 Eckstein ..... F16B 7/00 248/280.11
3,790,773 A * 2/1974 Sapper ..... F21V 21/26 248/123.2
(Continued)

FOREIGN PATENT DOCUMENTS

CA 2072783 12/1993
CN 101463955 6/2009
(Continued)

OTHER PUBLICATIONS

Machine translation of Wang, CN 204042584U, published Dec. 24, 2014.*
(Continued)

*Primary Examiner* — Peggy Neils
*Assistant Examiner* — William N Harris
(74) *Attorney, Agent, or Firm* — Blakely Sokoloff Taylor & Zafman LLP

(57) ABSTRACT

A table lamp including a base, a lamp handle, a lamp holder provided with a light source and an adjustment component. The base can be placed on a placement surface, and a bottom surface of the base is a curved surface. The adjustment component can adjust the center of gravity of the table lamp
(Continued)

by varying the center of gravity thereof, to thereby change a contact position of the bottom surface of the base and the placement surface, and thus change the illumination angle of the lamp holder. Since this technical solution adjusts the illumination angle of the lamp holder by adjusting the center of gravity of the table lamp instead of rotating the lamp holder, it solves the problem of breakage of the connection part of the lamp handle and the lamp holder caused by rotation of the lamp holder.

10 Claims, 5 Drawing Sheets

(51) Int. Cl.

| | |
|---|---|
| ***F21V 21/06*** | (2006.01) |
| ***F21S 6/00*** | (2006.01) |
| ***F21V 17/10*** | (2006.01) |
| ***F21V 21/40*** | (2006.01) |
| ***F21V 23/00*** | (2015.01) |
| ***F21V 21/30*** | (2006.01) |
| ***F21Y 115/10*** | (2016.01) |

(52) U.S. Cl.
CPC ..... *F21V 21/30* (2013.01); *F21V 21/40* (2013.01); *F21V 23/002* (2013.01); *F21Y 2115/10* (2016.08)

(58) Field of Classification Search
USPC ..... 362/413, 401, 410; 248/125.3, 123.2, 248/162.1, 364
See application file for complete search history.

(56) References Cited

U.S. PATENT DOCUMENTS

| | | | | |
|---|---|---|---|---|
| 4,453,204 | A * | 6/1984 | Warshawsky | F21S 6/002 248/296.1 |
| 4,706,172 | A * | 11/1987 | Lebowitz | F16M 11/40 174/117 FF |
| 5,001,617 | A | 3/1991 | Chan | |
| 5,664,747 | A * | 9/1997 | Eilering | F16M 11/041 248/123.11 |
| 6,871,985 | B2 * | 3/2005 | Humphrey | F21V 21/06 248/346.2 |
| 2012/0294004 | A1 * | 11/2012 | Stathis | F21V 21/26 362/249.1 |
| 2015/0354749 | A1 * | 12/2015 | Talbot | F16M 11/2042 359/811 |
| 2016/0131342 | A1 * | 5/2016 | Chen | F21S 6/003 362/413 |

FOREIGN PATENT DOCUMENTS

| | | |
|---|---|---|
| CN | 202216054 | 5/2012 |
| CN | 204042584 | 12/2014 |
| CN | 204042584 U | 12/2014 |
| CN | 204187564 | 3/2015 |
| DE | 19703567 | 8/1998 |

OTHER PUBLICATIONS

Office Action in Chinese Application No. 201510095574.6 dated Sep. 27, 2016, with English translation. 6 pages.
International Search Report and Written Opinion with English Language Translation, dated Sep. 11, 2015, Application No. PCT/CN2015/083944.

* cited by examiner

TABLE LAMP

FIELD OF THE INVENTION

The present invention relates to the field of lighting fixture, and in particular to a table lamp.

BACKGROUND ART

The table lamp is a moveable lighting tool, which can be disposed on a desk or a table for illumination. The illumination range of a table lamp is very small, and hence light of the entire room will not be influenced when a table lamp is used for illumination. Moreover, since a table lamp usually has very concentrated light, it can be widely used for the illumination of reading, studying and so on. In order to achieve an optimal illumination angle for a table lamp, it is usually necessary to adjust the illumination angle of the table lamp.

In the prior art, there is a table lamp with an adjustable illumination angle, which can also be called an omnidirectional lamp. The omnidirectional lamp usually comprises: a base, a lamp handle and a lamp holder provided with a light source, wherein the lamp handle is in fixed connection with the base and the lamp handle is in moveable connection with the lamp holder. To ensure that the omnidirectional lamp can be placed steadily, a contact surface where the base contacts a placement surface of the omnidirectional lamp is usually planar. In the adjustment of the illumination angle of the omnidirectional lamp, the Omnidirectional lamp is placed on the placement surface via the base, and the lamp holder of the omnidirectional lamp is rotated up and down such that the illumination angle of the omnidirectional lamp achieves the optimal illumination angle.

SUMMARY OF THE INVENTION

During the implementation of the present invention, the inventor found at least following problems with the omnidirectional lamp in the prior art:

When the illumination angle is adjusted by rotating the lamp holder, a connection part of the lamp handle and the lamp holder may be broken due to frequent rotations of the lamp holder, which influences the service life of the table lamp.

In order to solve the problem of breakage of the connection part of the lamp handle and the lamp holder caused by rotation of the lamp holder in the prior art that influences the service life of the table lamp, a table lamp is provided in an embodiment of the present invention.

According to a first aspect of the embodiment, a table lamp is provided, the table lamp comprises: a base, a lamp handle, a lamp holder provided with a light source and an adjustment component, the lamp handle is in fixed connection with the base, the lamp holder and the adjustment component, respectively;

the base can be placed on a placement surface, and a bottom surface of the base is a curved surface, and the center of gravity of the table lamp falls on the base;

the adjustment component is capable of adjusting the center of gravity of the table lamp by varying the center of gravity of the adjustment component, to thereby change a contact position of the bottom surface of the base and the placement surface and thus make the illumination angle of the lamp holder change.

Optionally, the base is provided with a cavity inside, and a fixed weight is arranged on the bottom of the cavity.

Optionally, a position of the fixed weight on the bottom of the cavity can vary with the contact position of the bottom surface of the base and the placement surface.

Optionally, the adjustment component comprises: a lamp shank and poises, one end of the lamp shank is in fixed connection with the lamp handle, and the poises can be attached to the lamp shank;

the center of gravity of the adjustment component can be varied by adjusting the number of the poises and/or positions of the poises on the lamp shank.

Optionally, the poises or the lamp shank has magnetism such that the poises can be attracted to the lamp shank.

Optionally, the magnetism is ferromagnetism, and the lamp shank or the poises are made of iron.

Optionally, the poises are of annular structures, and the lamp shank is of a cylindrical structure;

a block is arranged on a lateral surface of the lamp shank, the block comprising: a fixed block and/or a moveable block, the fixed block is positioned on the lamp shank fixedly, and the position of the moveable block on the lamp shank can be varied;

the poises are nested around the lamp shank and stuck on the lamp shank by means of the block.

Optionally, the moveable block can be stuck on the lamp shank;

and/or the moveable block can be attracted to the lamp shank.

Optionally, the poises are of annular structures, and an opening is provided on a lateral surface of respective poises, the size of the opening being adjustable;

the poises can be nested around the lamp shank by adjusting the size of the opening.

Optionally, the light source is a light emitting diode (LED) light source.

Optionally, the fixed weight is made of sandstone.

Optionally, the fixed weight is made of a fluid.

Optionally, the table lamp further comprises: a power line, both the base and the lamp handle are provided with a channel for the passage of the power line;

the power line sequentially passes through the channel in the base and the channel in the lamp handle and is connected with the lamp holder.

The beneficial effects brought by the technical solution provided in the above embodiment of the present invention include:

The table lamp provided in the above embodiment of the present invention comprises a base, a lamp handle, a lamp holder provided with a light source and an adjustment component. The bottom surface of the base is arranged to be curved such that, when the center of gravity of the table lamp is adjusted by varying the center of gravity of the adjustment component, the contact position of the bottom surface of the base and the placement surface can be changed, and thereby the illumination angle of the lamp holder is also changed. Since this technical solution adjusts the illumination angle of the lamp holder by adjusting the center of gravity of the table lamp instead of rotating the lamp holder, it solves the problem of breakage of the connection part of the lamp handle and the lamp holder caused by rotation of the lamp holder that influences the service life of the table lamp, and achieves the effect of avoiding breakage of the lamp holder and prolonging the service life of the table lamp.

BRIEF DESCRIPTION OF DRAWINGS

In order to explain the technical solutions in the embodiments of the present invention more clearly, the drawings to be used in the description of the embodiments will be briefly introduced as follows. Apparently, the drawings described below are only some of the embodiments of the present invention, and for those having ordinary skills in the art, other drawings are also derivable based on these drawings without any inventive efforts.

DETAILED DESCRIPTION OF EMBODIMENTS

To render the goal, technical solutions and advantages of the present invention clearer, the embodiments of the present invention shall be further described in detail as follows with reference to the drawings.

Figure 1:
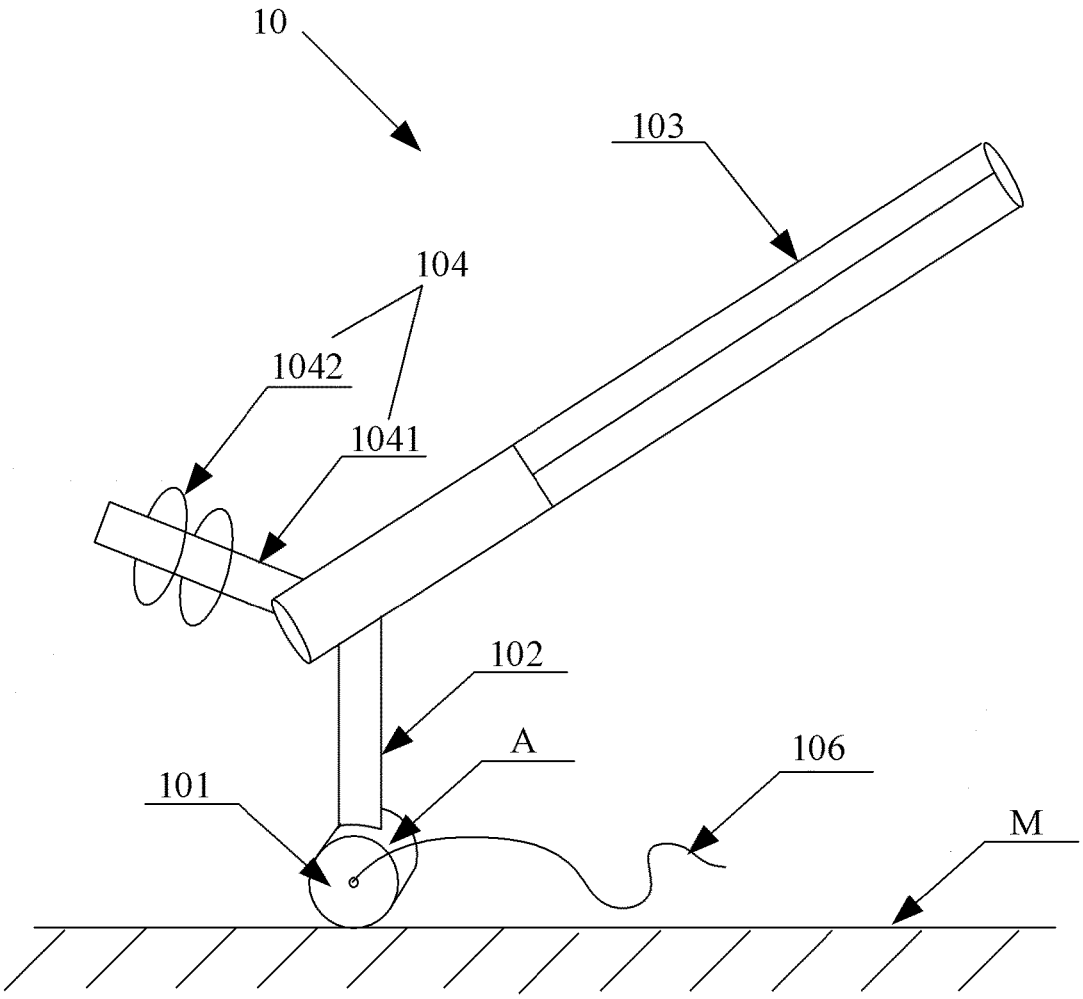
FIG. 1 is a schematic structural view of a table lamp provided in an embodiment of the present invention.

With reference to FIG. 1, it shows a schematic structural view of a table lamp 10 provided in an embodiment of the present invention. The table lamp 10 can be used for the illumination of reading, studying, working and so on. Referring to FIG. 1, the table lamp 10 comprises: a base 101, a lamp handle 102, a lamp holder 103 provided with a light source and an adjustment component 104.

Wherein, the lamp handle 102 is in fixed connection with the base 101, the lamp holder 103 and the adjustment component 104, respectively. The base 101 can be placed on a placement surface M, and a bottom surface A of the base 101 is a curved surface, and the center of gravity of the table lamp 10 falls on the base 101.

Wherein, the adjustment component 104 is capable of adjusting the center of gravity of the table lamp 10 by varying the center of gravity of the adjustment component 104, to thereby change a contact position of the bottom surface A of the base 101 and the placement surface and thus make the illumination angle of the lamp holder 103 change. As shown in FIG. 1, the adjustment component 104 may comprise: a lamp shank 1041 and poises 1042. According to a specific implementation, the center of gravity of the adjustment component may be varied by adjusting the number of the poises 1042 and/or positions of the poises 1042 on the lamp shank 1041.

Furthermore, as shown in FIG. 1, the table lamp 10 further comprises: a power line 106.

Both the base 101 and the lamp handle 102 may be provided with a channel (not shown in FIG. 1) for the passage of the power line 106. The power line 106 can sequentially pass through the channel in the base 101 and the channel in the lamp handle 102 and be connected with the lamp holder 103. A power source connected with the power line 106 provides electricity for the lamp holder 103 via the power line 106.

What needs to be noted is that in order to achieve an illumination effect which is energy-saving, environmentally friendly and highly efficient, the light source in the embodiment of the present invention may be a light emitting diode (LED) light source.

What needs to be further explained is that in several embodiments of the present invention, the lamp holder 103 may comprise a lamp housing and an LED light source. The lamp housing may be provided with a fitting groove, and the LED light source is fixed into the fitting groove to be secured to the lamp housing; or the LED light source has a rod structure, and the lamp housing is provided with a fitting hole, and the LED light source is fixed into the fitting hole at one end to be secured to the lamp housing; or the LED light source can be secured to the lamp housing otherwise, which will not be limited in the embodiments of the present invention. Alternatively, the lamp holder 103 may comprise only a light source capable of being in fixed connection with the lamp handle 102, and the lamp holder 103 will not be specifically limited in the embodiments of the present invention.

To sum up, in a table lamp provided in an embodiment of the present invention, the bottom surface of the base is arranged to be curved such that, when the center of gravity of the table lamp is adjusted by varying the center of gravity of the adjustment component, the contact position of the bottom surface of the base and the placement surface can be changed, and thereby the illumination angle of the lamp holder is also changed. Since this technical solution adjusts the illumination angle of the lamp holder by adjusting the center of gravity of the table lamp instead of rotating the lamp holder, it solves the problem of breakage of the connection part of the lamp handle and the lamp holder caused by rotation of the lamp holder that influences the service life of the table lamp, and achieves the effect of avoiding breakage of the lamp holder and prolonging the service life of the table lamp.

Figure 2:
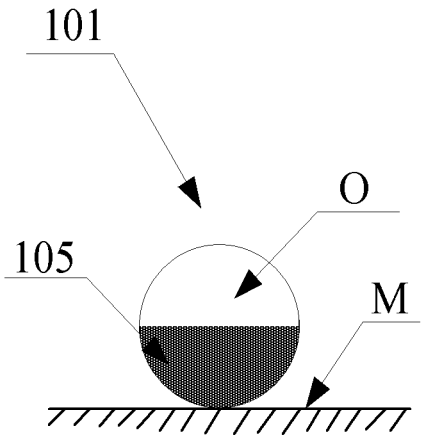
FIG. 2 is a sectional view of a base of the table lamp in the embodiment as shown in FIG. 1.

Furthermore, as shown in FIG. 2, it shows a sectional view of the base 101 of the table lamp 10 in the embodiment as shown in FIG. 1, wherein the base 101 is placed on the placement surface M. The base 101 may be provided with a cavity O inside, and on the bottom of the cavity O a fixed weight 105 may be arranged for steadying the base 101 and the table lamp 10. Optionally, a position of the fixed weight 105 on the bottom of the cavity O can vary with the contact position of the bottom surface A of the base 101 and the placement surface in FIG. 1. In a possible implementation, the fixed weight 105 may be made of sandstone. Exemplarily, the fixed weight 105 may be made of sandstone and placed on the bottom of the cavity O; in a further possible implementation, when the cavity O is a hermetic cavity, the fixed weight 105 may further be made of a fluid and placed inside the cavity O, wherein when the fixed weight 105 is made of a fluid, the specific material of the fluid is subject to the condition that the fluid does not influence the operation of the table lamp 10, and the mass of the fluid is very heavy.

What needs to be explained is that explanations are given in FIG. 2 by taking a cylindrical structure of the base 101 as an example, wherein a lateral surface of the cylindrical structure is namely the bottom surface A of the base 101 in FIG. 1. In fact, the base 101 may further be of any other structure with a curved bottom surface, e.g., a spherical structure and the like. The shape of the base 101 will not be specifically limited in the embodiments of the present invention.

Furthermore, as shown in FIG. 1, the adjustment component 104 may comprise: a lamp shank 1041 and poises 1042.

Wherein, the number of the poises 1042 may be a preset value, e.g., 1 or 2. Optionally, the lamp shank 1041 may be of a rod structure with one end in fixed connection with the lamp handle 102, and the poises 1042 can be attached to the lamp shank 1041. The center of gravity of the adjustment component 104 can be varied by adjusting the number of the poises 1042 and/or positions of the poises 1042 on the lamp shank 1041. That is, the center of gravity of the adjustment component 104 is varied by adjusting the number of the poises 1042 on the lamp shank 1041, or by adjusting the positions of the poises 1042 on the lamp shank 1041, or by simultaneously adjusting the number of the poises 1042 and the positions of the poises 1042 on the lamp shank 1041.

In order to achieve adjustment of the number of the poises 1042 and/or positions of the poises 1042 on the lamp shank 1041, the following two ways of attaching the poises 1042 to the lamp shank 1041 are provided in some of the embodiments of the present invention:

a. the poises 1042 are attached to the lamp shank 1041 by attraction.

For example, the poises 1042 or the lamp shank 1041 may have magnetism such that the poises 1042 can be attracted to the lamp shank 1041. In a specific implementation, the poises 1042 may have ferromagnetism, and the lamp shank 1041 may be made of iron; or in further specific implementation, the lamp shank 1041 may have ferromagnetism, and the poises 1042 may be made of iron. In this way, the poises 1042 can be attracted to the lamp shank 1041, thereby enabling the attachment of the poises 1042 to the lamp shank 1041.

b. the poises 1042 are attached to the lamp shank 1041 by muff coupling.

Figure 3:
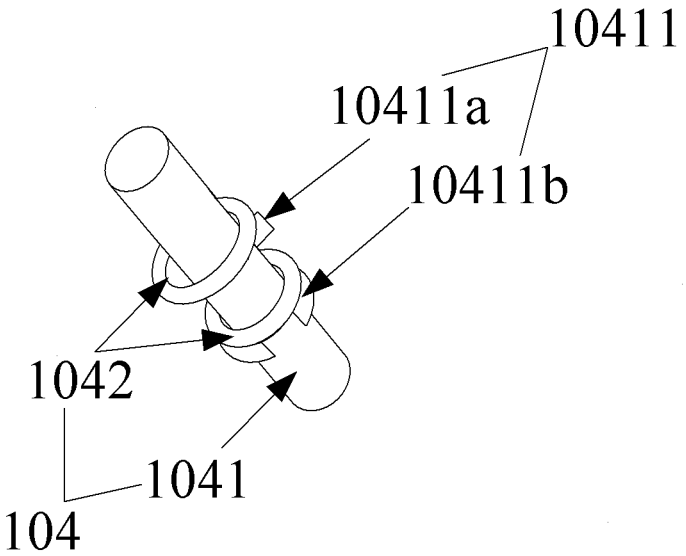
FIG. 3 is a schematic structural view of an adjustment component of the table lamp in the embodiment as shown in FIG. 1.

On one hand, as shown in FIG. 3, it shows a schematic structural view of an adjustment component 104 of the table lamp 10 in the embodiment as shown in FIG. 1. The poises 1042 may be of annular structures, and the lamp shank 1041 may be of a cylindrical structure. A block 10411 is arranged on a lateral surface of the lamp shank 1041, and the block 10411 may comprise: a fixed block 10411*a* and/or a moveable block 10411*b*. The poises 1042 are nested around the lamp shank 1041 and stuck on the lamp shank 1041 by means of the block 10411.

Wherein, for both the fixed block 10411*a* and the moveable block 10411*b*, there can be one or more of them. The fixed block 10411*a* is positioned on the lamp shank 1041 fixedly. Exemplarily, the fixed block 10411*a* may be welded onto the lamp shank 1041. The position of the moveable block 10411*b* on the lamp shank 1041 can be varied. For example, the moveable block 10411*b* or the lamp shank 1041 may have magnetism, such that the moveable block 10411*b* can be attracted to the lamp shank 1041. In a specific implementation, the moveable block 10411*b* may have ferromagnetism, and the lamp shank 1041 may be made of iron; or the lamp shank 1041 may have ferromagnetism, and the moveable block 10411*b* may be made of iron, and thus the moveable block 10411*b* can be attracted to the lamp shank 1041. Alternatively, the moveable block 10411*b* may be made of a deformable material and be of an annular structure with an opening. The moveable block 10411*b* can be attached to the lamp shank 1041 by means of adjustment of the opening of the moveable block 10411*b*. What needs to be explained is that the fixed block 10411*a* and the moveable block 10411*b* may be either in the same shape or not in the embodiment. The fixed block 10411*a* and the moveable block 10411*b* may also be in other shapes, which will not be limited in the embodiments of the present invention.

Figure 4:
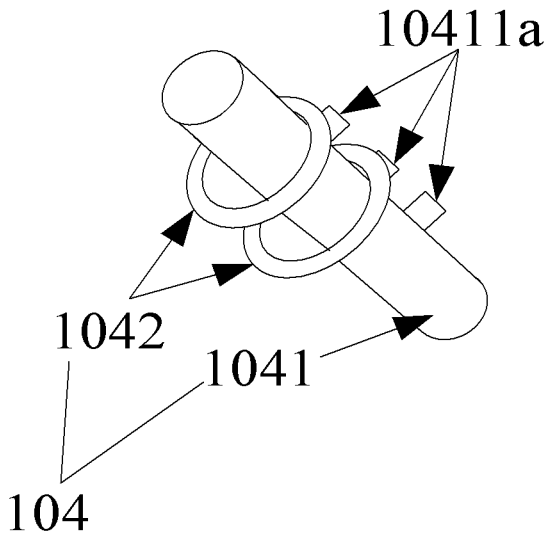
FIG. 4 is a schematic structural view of another adjustment component of the table lamp in the embodiment as shown in FIG. 1.

What needs to be further explained is that the block 10411 in the embodiments of the present invention may also comprise only a fixed block 10411*a* or a moveable block 10411*b*. Specifically:

As shown in FIG. 4, it shows a schematic structural view of another adjustment component 104 of the table lamp 10 in the embodiment as shown in FIG. 1. In FIG. 4, the block 10411 only comprises a fixed block 10411*a*, wherein the poises 1042 are nested around the lamp shank 1041 and stuck on the lamp shank 1041 by means of the fixed block 10411*a*. Exemplarily, a diameter of respective poises 1042 is greater than the sum of a diameter of the lamp shank 1041 and a height of the fixed block 10411*a*. After the poises 1042 are nested around the lamp shank 1041, the poises 1042 are in contact with the fixed block 10411*a*. Under the effect of their own weight and the support of the fixed block 10411*a*, the poises 1042 can be stuck on the lamp shank 1041 by means of the fixed block 10411*a*. Wherein, the height of the fixed block 10411*a* is a length of the fixed block 10411*a* in a direction perpendicular to the lateral surface of the lamp shank 1041.

Figure 5:
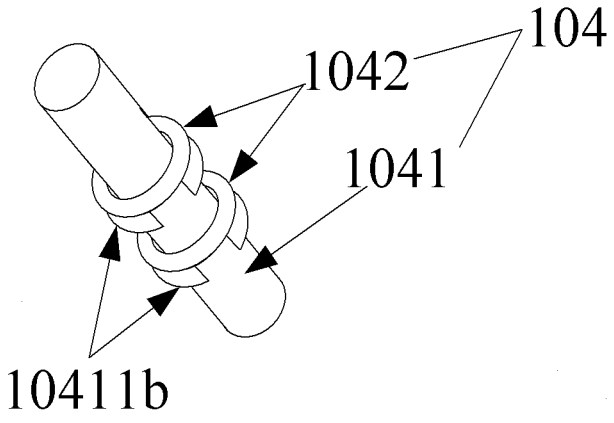
FIG. 5 is a schematic structural view of yet another adjustment component of the table lamp in the embodiment as shown in FIG. 1.

As shown in FIG. 5, it shows a schematic structural view of yet another adjustment component 104 of the table lamp 10 in the embodiment as shown in FIG. 1. In FIG. 5, the block 10411 only comprises a moveable block 10411*b*, wherein the poises 1042 are nested around the lamp shank 1041 and stuck on the lamp shank 1041 by means of the moveable block 10411*b*. Exemplarily, the moveable block 10411*b* is attracted to the lamp shank 1041, or the moveable block 10411*b* is attached to the lamp shank 1041 by means of adjustment of the opening of the moveable block 10411*b*. After the poises 1042 are nested around the lamp shank 1041, the poises 1042 are in contact with the moveable block 10411*b*. Under the effect of their own weight and the support of the moveable block 10411*b*, the poises 1042 can be stuck on the lamp shank 1041 by means of the moveable block 10411*b*.

Figure 6:
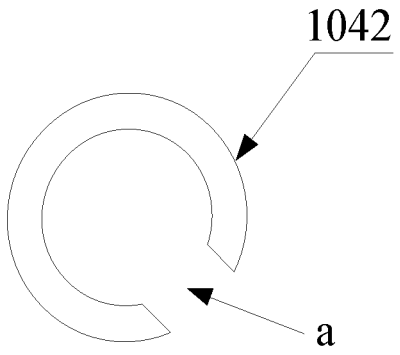
FIG. 6 is a schematic structural view of poises of the table lamp in the embodiment as shown in FIG. 1.

On the other hand, as shown in FIG. 6, it shows a schematic structural view of poises 1042 of the table lamp 10 in the embodiment as shown in FIG. 1. The poises 1042 may be of annular structures, and an opening a may be provided on a lateral surface of respective poises 1042. Optionally, the poises 1042 may be made of a deformable material, such as metals like iron, copper and so on, and the size of the opening a is adjustable.

Figure 7:
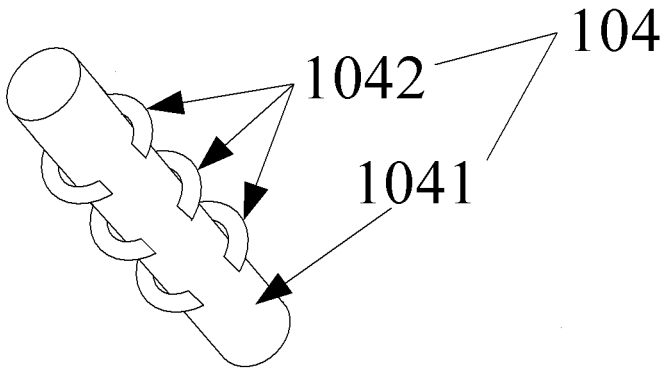
FIG. 7 is a schematic structural view of still another adjustment component of the table lamp in the embodiment as shown in FIG. 1.

As shown in FIG. 7, it shows a schematic structural view of still another adjustment component 104 of the table lamp 10 in the embodiment as shown in FIG. 1. Wherein, the poises 1042 can be nested around the lamp shank 1041 by adjusting the size of the opening a. When the poises 1042 are detached from the lamp shank 1041, the detached poises 1042 may be nested around the lamp handle 102 in order to prevent the poises 1042 from being lost. Exemplarily, the poises 1042 are operated such that they can be nested around the lamp shank 1041 by means of the opening a. After that, operation of the poises 1042 is continued such that the opening a of the poises 1042 is reduced until the poises 1042 are attached to the lamp shank 1041.

To sum up, in a table lamp provided according to an embodiment of the present invention, the bottom surface of the base is arranged to be curved such that, when the center of gravity of the table lamp is adjusted by varying the center of gravity of the adjustment component, the contact position of the bottom surface of the base and the placement surface can be changed, and thereby the illumination angle of the lamp holder is also changed. Since this technical solution adjusts the illumination angle of the lamp holder by adjusting the center of gravity of the table lamp instead of rotating the lamp holder, it solves the problem of breakage of the connection part of the lamp handle and the lamp holder caused by rotation of the lamp holder that influences the service life of the table lamp, and achieves the effect of avoiding breakage of the lamp holder and prolonging the service life of the table lamp.

Figure 8:
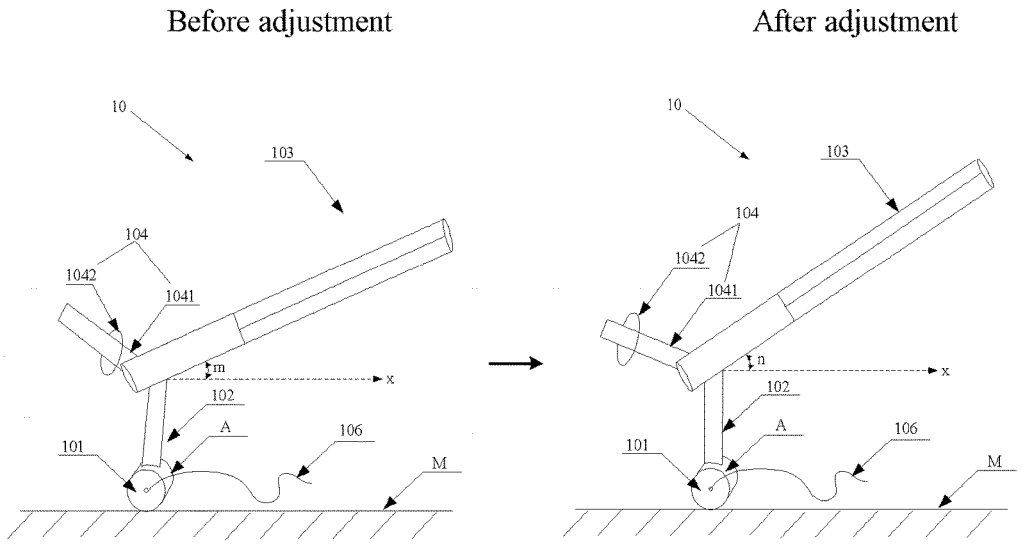
FIG. 8 is a principle diagram for the adjustment of the illumination angle of the table lamp provided in an embodiment of the present invention.

FIG. 8 is a principle diagram for the adjustment of the illumination angle of the table lamp 10 provided in an embodiment of the present invention. Firstly, the table lamp 10 is placed on the placement surface M. Then, the positions of poises 1042 on the lamp shank 1041 are adjusted such that the center of gravity of the adjustment component 104 is varied (moving leftwards in FIG. 8), and thus the center of gravity of the table lamp 10 is also varied (moving leftwards in FIG. 8). Under the effect of gravity, the table lamp 10 is rotated (leftwards or counter-clockwise in FIG. 8), so the contact position of the bottom surface A of the base 101 and the placement surface is changed, and the illumination angle of the lamp holder 103 is changed correspondingly. Assuming that the illumination angle of the lamp holder 103 before the adjustment is an angle m enclosed between the lamp holder 103 and the horizontal direction x, during the adjustment of the positions of poises 1042 such that the poises 1042 depart from the lamp holder 103, the illumination angle m of the lamp holder 103 will increase to n. If it is necessary to decrease the illumination angle of the lamp holder 103, the positions of the poises 1042 may be adjusted such that the poises 1042 approach the lamp holder 103, and thus the illumination angle m of the lamp holder 103 will decrease. The illumination angle of the lamp holder 103 can be adjusted to the optimal illumination angle by executing the above steps repeatedly.

Alternatively, in the table lamp 10 provided in an embodiment of the present invention the illumination angle of the lamp holder 103 may be further adjusted by adjusting the number of the poises 1042. Exemplarily, the table lamp 10 is placed on the placement surface M, and then poises 1042 are added to the lamp shank 1041. As a result, the center of gravity of the adjustment component 104 is varied, and the center of gravity of the table lamp 10 is also varied. Under the effect of gravity, the table lamp 10 is rotated, so the contact position of the bottom surface A of the base 101 and the placement surface is changed, and the illumination angle of the lamp holder 103 is changed correspondingly. Assuming that the illumination angle of the lamp holder 103 before the adjustment is an angle m enclosed between the lamp holder 103 and the horizontal direction x, during the addition of the poises 1042, the illumination angle of the lamp holder 103 will increase. If it is necessary to decrease the illumination angle of the lamp holder 103, the poises 1042 may be detached from the lamp shank 1041, and during the detachment of the poises 1042, the illumination angle of the lamp holder 103 will decrease. The illumination angle of the lamp holder 103 can be adjusted to the optimal illumination angle by executing the above steps repeatedly.

Alternatively, in the table lamp 10 provided in an embodiment of the present invention the illumination angle of the lamp holder 103 may be further adjusted by simultaneously adjusting the number of the poises 1042 and the positions of the poises 1042. Exemplarily, the table lamp 10 is placed on the placement surface, and then poises 1042 are added to the lamp shank 1041 and meanwhile positions of the poises 1042 are adjusted. As a result, the center of gravity of the adjustment component 104 is varied, and the center of gravity of the table lamp 10 is also varied. Under the effect of gravity, the table lamp 10 is rotated, so the contact position of the bottom surface A of the base 101 and the placement surface is changed, and the illumination angle of the lamp holder 103 is changed correspondingly. Assuming that the illumination angle of the lamp holder 103 before the adjustment is an angle m enclosed between the lamp holder 103 and the horizontal direction x, during the addition of the poises 1042 and the adjustment of the positions of poises 1042 such that the poises 1042 depart from the lamp holder 103, the illumination angle of the lamp holder 103 will increase. If it is necessary to decrease the illumination angle of the lamp holder 103, the poises 1042 may be detached from the lamp shank 1041 and positions of the rest poises 1042 may be adjusted such that the rest poises 1042 approach the lamp holder 103, and thus the illumination angle of the lamp holder 103 will decrease. The illumination angle of the lamp holder 103 can be adjusted to the optimal illumination angle by executing the above steps repeatedly.

What needs to be explained is that the procedures and the principles of adjusting the illumination angle of the lamp holder 103 by adjusting the number of the poises 1042 and by simultaneously adjusting the number of the poises 1042 and the positions of the poises 1042 have been explained above. Those having ordinary skills in the art can understand the principles and obtain the principle diagram with reference to FIG. 8.

In conclusion, in a table lamp provided in some embodiments of the present invention, the bottom surface of the base is arranged to be curved such that, when the center of gravity of the table lamp is adjusted by varying the center of gravity of the adjustment component, the contact position of the bottom surface of the base and the placement surface can be changed, and thereby the illumination angle of the lamp holder is also changed. Since this technical solution adjusts the illumination angle of the lamp holder by adjusting the center of gravity of the table lamp instead of rotating the lamp holder, it solves the problem of breakage of the connection part of the lamp handle and the lamp holder caused by rotation of the lamp holder that influences the service life of the table lamp, and achieves the effect of avoiding breakage of the lamp holder and prolonging the service life of the table lamp.

The present invention has been described above in combination with the specific embodiments of the present invention. It should be pointed out that the above embodiments are used to exemplify the present invention rather than limit it, and those having ordinary skills in the art can design many alternative embodiments without deviating from the scope of the claims attached thereto.

The term "and/or" used in the present application is only used to describe an association relationship of associated objects, and it means that there can be three relationships. For example, "A and/or B" can represent the following three cases: only A exists; A and B both exist; only B exists. Besides, the symbol "/" throughout the text generally means that the objects associated thereby have an "or" relationship.

What is stated above is only specific embodiments of the present invention, but the protection scope of the present invention shall not be limited thereto. Any modification, equivalent substitution or improvement within the spirit and principle of the present invention shall fall within the protection scope of the present invention. Therefore, the protection scope of the present invention shall be subject to the protection scope of the claims.

In the claims, any reference signs placed within parentheses shall not be construed as limiting the claims. The term "comprising" does not exclude presence of elements or steps other than those listed in the claims. The word "a" or "an" before an element does not exclude presence of a plurality of such elements.

In an apparatus or system claim listing several devices, one or more of the devices can be embodied in a same hardware item. The mere fact that certain measures are stated in mutually different dependent claims does not indicate that the combination of these measures cannot be used to advantage.

The invention claimed is:

1. A table lamp, the table lamp comprising: a base, a lamp handle, a lamp holder provided with a light source and an adjustment component, wherein the lamp handle is in fixed connection with the base, the lamp holder and the adjustment component, respectively;

the base can be placed on a placement surface, and a bottom surface of the base is a curved surface, and a center of gravity of the table lamp falls on the base;

the adjustment component is capable of adjusting the center of gravity of the table lamp by varying a center of gravity of the adjustment component, to thereby change a contact position of the bottom surface of the base and the placement surface, and thus make the illumination angle of the lamp holder change, the adjustment component comprises: a lamp shank and poises, one end of the lamp shank is in fixed connection with the lamp handle, and the poises can be attached to the lamp shank;

the center of gravity of the adjustment component can be varied by adjusting at least one of a number of the poises and positions of the poises on the lamp shank, the poises are annular structures, and an opening is provided on a lateral surface of respective poises, a size of the opening being adjustable; and the poises can be nested around the lamp shank by adjusting the size of the opening.

2. The table lamp according to claim 1, wherein the base is provided with a cavity inside, and a fixed weight is arranged on a bottom of the cavity.

3. The table lamp according to claim 2, wherein a position of the fixed weight on the bottom of the cavity can vary with a contact position of the bottom surface of the base and the placement surface.

4. The table lamp according to claim 1, wherein the poises or the lamp shank has magnetism such that the poises can be attracted to the lamp shank.

5. The table lamp according to claim 1, wherein the poises are annular structures, and the lamp shank is a cylindrical structure; a block is arranged on a lateral surface of the lamp shank, the block comprising: at least one of a fixed block and a moveable block, the fixed block is fixedly positioned on the lamp shank, and a variable position of the moveable block on the lamp shank; the poises are nested around the lamp shank and stuck on the lamp shank by means of the block.

6. The table lamp according to claim 5, wherein the moveable block is one of stuck on the lamp shank, and attracted to the lamp shank.

7. The table lamp according to claim 1, wherein the light source is a light emitting diode (LED) light source.

8. The table lamp according to claim 3, wherein the fixed weight is made of sandstone.

9. The table lamp according to claim 3, wherein the fixed weight is made of a fluid.

10. The table lamp according to claim 7, wherein the table lamp further comprises: a power line, both the base and the lamp handle are provided with a channel for the passage of the power line;

the power line sequentially passes through the channel in the base and the channel in the lamp handle, and is connected with the lamp holder.

* * * * *